US011015362B1

(12) United States Patent
Fragmin

(10) Patent No.: US 11,015,362 B1
(45) Date of Patent: May 25, 2021

(54) POST PROTECTOR

(71) Applicant: Gary J Fragmin, Philippi, WV (US)

(72) Inventor: Gary J Fragmin, Philippi, WV (US)

( * ) Notice: Subject to any disclaimer, the term of this patent is extended or adjusted under 35 U.S.C. 154(b) by 0 days.

(21) Appl. No.: 16/903,816

(22) Filed: Jun. 17, 2020

(51) Int. Cl.
*E04H 12/22* (2006.01)

(52) U.S. Cl.
CPC ..... *E04H 12/2292* (2013.01)

(58) Field of Classification Search
CPC ..... E04H 12/2292
See application file for complete search history.

(56) References Cited

U.S. PATENT DOCUMENTS 5,503,371 A * 4/1996 Bies ..... E04H 12/2292 256/1
5,622,356 A * 4/1997 Duggan ..... E04H 12/2292 256/1
7,104,525 B2 * 9/2006 Ricci ..... E04H 12/2292 256/1
9,010,069 B2 * 4/2015 Bernard ..... E04H 12/2292 52/844
9,032,694 B2 * 5/2015 Bernard ..... E04H 12/2292 52/844
9,085,915 B1 * 7/2015 Emmett ..... E04H 12/2292
9,482,023 B1 * 11/2016 Carmody ..... E04H 12/2292
10,450,759 B1 * 10/2019 Carmody ..... A47G 29/1216
10,480,207 B1 * 11/2019 Webster ..... E04H 12/2292
2005/0005540 A1 * 1/2005 Nesbitt ..... E04H 12/2292 52/169.9
2006/0038163 A1 * 2/2006 Ricci ..... E04H 12/2292 256/1
2007/0138452 A1 * 6/2007 Donabedian ..... E04H 12/2292 256/1
2007/0245645 A1 * 10/2007 Nesbitt ..... E04H 12/2292 52/169.9
2009/0126298 A1 * 5/2009 Salcedo ..... E04H 12/2292 52/288.1
2009/0236579 A1 * 9/2009 Sudnak ..... E04H 12/2292 256/1
2012/0180895 A1 * 7/2012 Brattain ..... E04H 12/2292 138/118.1
2013/0288068 A1 * 10/2013 Bernard ..... E04H 12/2292 428/595
2013/0295404 A1 * 11/2013 Bernard ..... B32B 3/04 428/595

* cited by examiner

*Primary Examiner* — Andrew J Triggs
(74) *Attorney, Agent, or Firm* — Fitch, Even, Tabin & Flannery, LLP

(57) ABSTRACT

A post protector includes an elongated hollow shaft, a handle provided at a first end of the elongated hollow shaft, the handle including a trigger mechanism, and a base portion provided at a second end of the elongated hollow shaft opposite the first end. A pair of protector panels are pivotally connected to the base portion and are movable between a use position in which distal ends of the panels are in contact to form together an internal shape corresponding to at least a portion of an external shape of a post to be protected, and an installation/removal position. An actuator mechanism is provided between and connected to the trigger mechanism and the protector panels. The actuator mechanism is responsive to movement of the trigger mechanism to move the pair of protector panels between the use position and the installation/removal position.

11 Claims, 5 Drawing Sheets

POST PROTECTOR

BACKGROUND OF THE INVENTION

Garden tools for cutting grass and weeds around the perimeter of property or near obstacles such as fences are well known and commonly used. One of the most popular type of garden tool for this purpose is a string trimmer, sometimes also called a weed-eater or weed-whacker. String trimmers cut the grass or weeds using a flexible monofilament line attached a rotating spindle at the end of a shaft with a handle at the opposite end.

When cutting around obstacles, such as posts for fences, mailboxes, etc., the monofilament line can damage the finish on the base of the post near the ground level and, over time, can actually wear away the material of the post.

Various post protecting devices are known (see, e.g., U.S. Pat. Nos. 7,104,525, 9,482,023 and 10,450,759). However, the post protectors of which applicant is aware are designed to be installed and left in place and/or the installation/removal is such that they would not be practical to install and remove each time the grass or weeds around the posts are trimmed.

SUMMARY OF THE INVENTION

The present invention relates to a post protector. The post protector includes an elongated hollow shaft, a handle provided at a first end of the elongated hollow shaft, the handle including a trigger mechanism, and a base portion provided at a second end of the elongated hollow shaft opposite the first end. A pair of protector panels are pivotally connected to the base portion and are movable between a use position in which distal ends of the panels are in contact to form together an internal shape corresponding to at least a portion of an external shape of a post to be protected, and an installation/removal position in which the distal ends of the panels are spaced to allow the panels to be installed around or removed from a post to be protected. An actuator mechanism is provided between and connected to the trigger mechanism and the protector panels. The actuator mechanism is responsive to movement of the trigger mechanism to move the pair of protector panels between the use position and the installation/removal position.

BRIEF DESCRIPTION OF THE SEVERAL VIEWS OF DRAWINGS

DETAILED DESCRIPTION OF THE INVENTION

Figure 1:
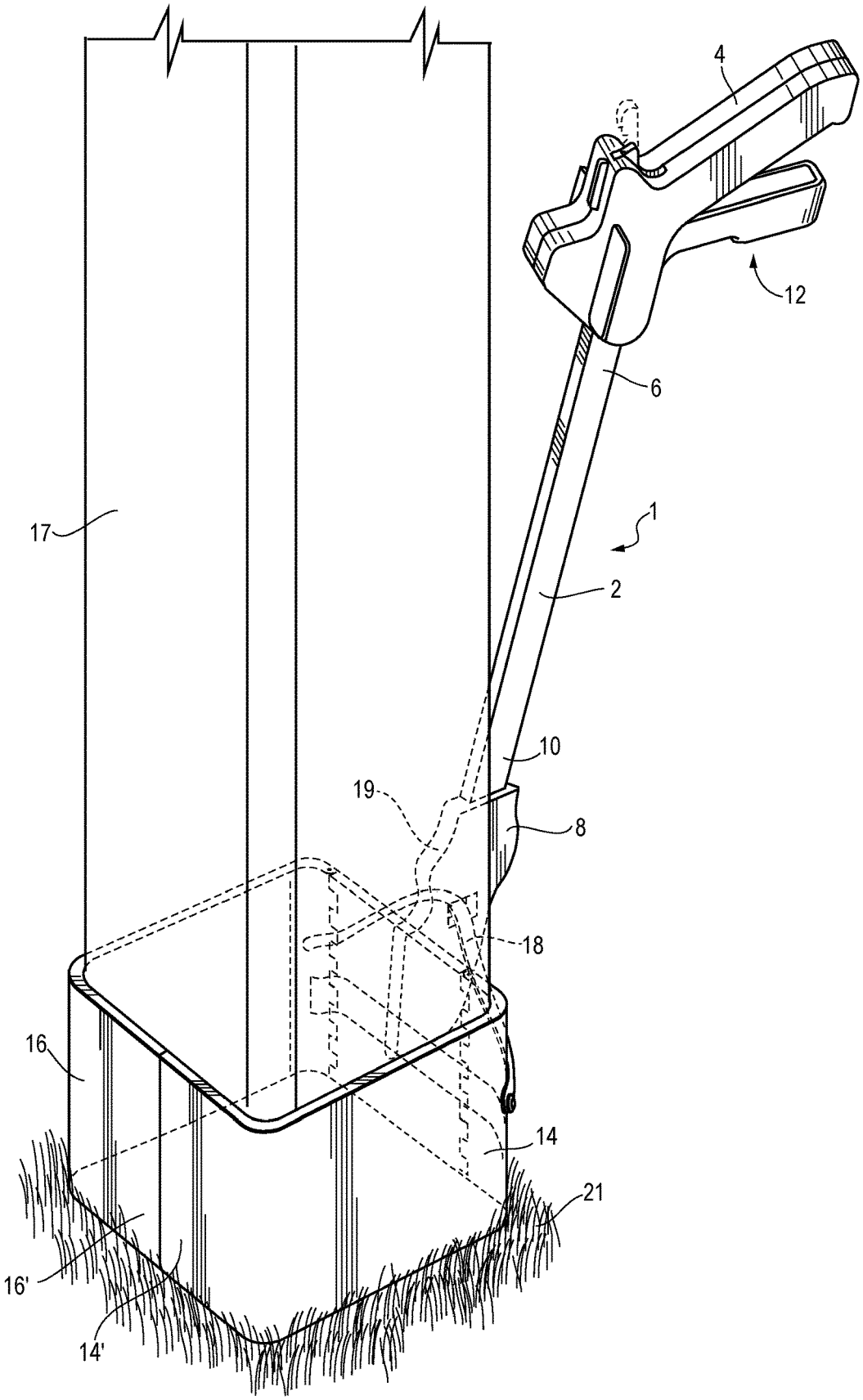
FIG. 1 is a perspective view of an embodiment of a post protector according to the present invention in use.

FIG. 1 is a perspective view of an embodiment of a post protector 1 according to the present invention in use. In this embodiment, the post protector 1 includes an elongated hollow shaft 2, a handle 4 provided at a first end 6 of the elongated hollow shaft, and a base portion 8 provided at a second end 10 of the elongated hollow shaft 2 opposite the first end 6. The handle includes a trigger mechanism 12 described in more detail hereinafter.

A pair of protector panels 14, 16 are pivotally connected to the base portion 8 and are movable between a use position in which distal ends 14', 16' of the panels 14, 16 are in contact to form together an internal shape corresponding to at least a portion of an external shape of a post 17 to be protected, and an installation/removal position in which the distal ends 14', 16' of the panels 14, 16 are spaced to allow the panels 14, 16 to be installed around or removed from a post 17 to be protected.

An actuator mechanism is provided between and connected to the trigger mechanism 12 and the protector panels 14, 16. In this embodiment, the actuator mechanism includes a pair of members, e.g., ribbons 18, 19 connected at a first end to the trigger 12, passing down through the hollow shaft 2, and connected at a second end to an outside portion of the pair of protector panels 14, 16.

FIG. 1 shows the post protector 1 in its use position in which the distal ends 14', 16' of the panels 14, 16 are in contact to form together an internal shape corresponding to at least a portion of an external shape of the post 17 so that base of the post can be protected from the monofilament of a string trimmer as the grass or weeds 21 around the base of the post 17 are trimmed.

Figure 2:
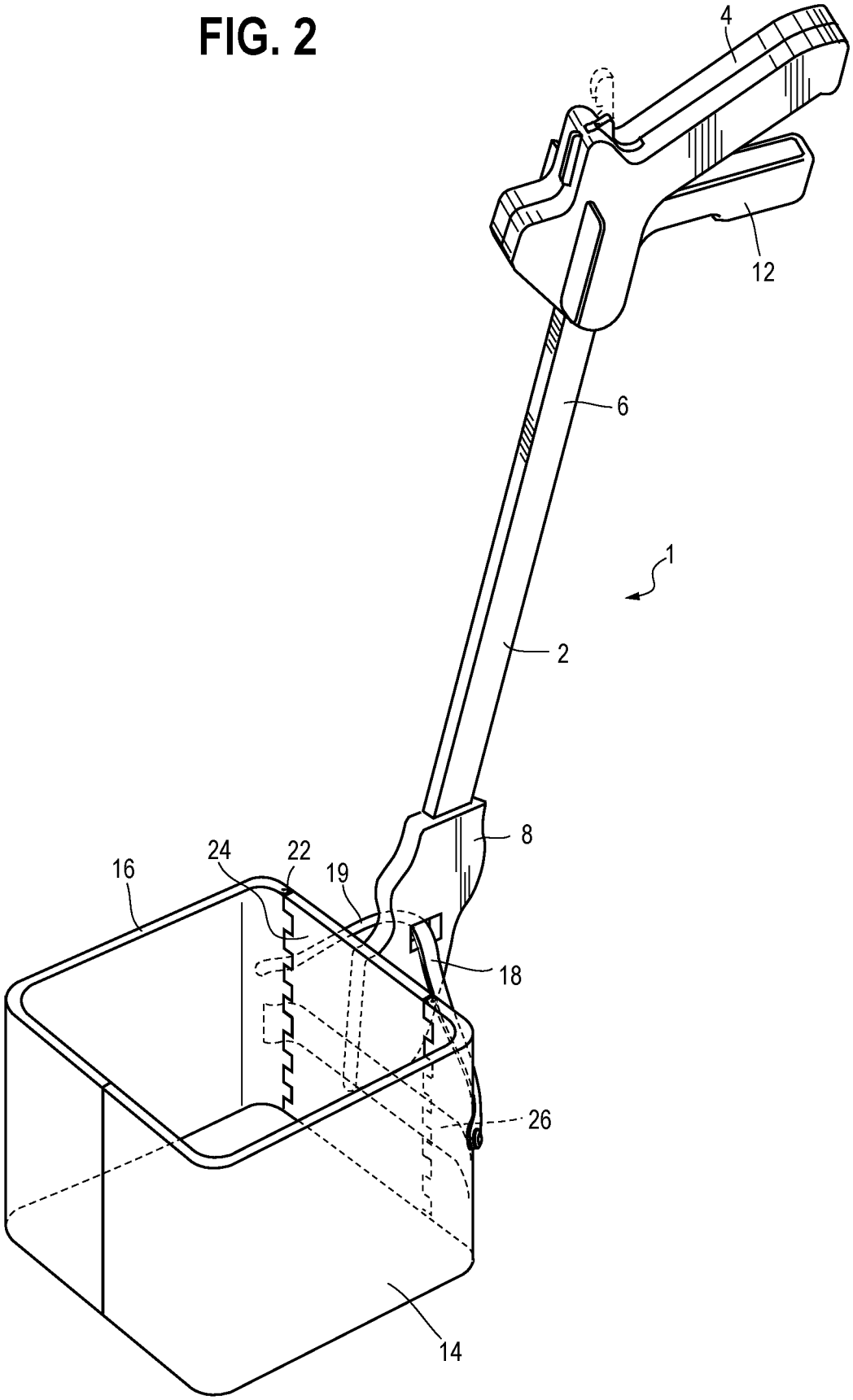
FIG. 2 is a perspective view of an embodiment of a post protector according to the present invention in a use (clamped) position.

As better shown in FIG. 2, each of the pair of protector panels 14, 16 is pivotally connected to the base portion 8 by a hinge 22. In this embodiment, the base portion 8 includes a panel 24 that forms part of the protection for the post. However, in other embodiments, the protector panels 14, 16 may, for example, both be connected to the base portion 8 by a single hinge without the panel 24.

In this embodiment, as shown in FIGS. 1 and 2, the pair of protector panels 14, 16 in the use position form together an internal shape having a substantially square cross-section corresponding to the cross-section of the post 17. For example, the pair of protector panels 14, 16 in the use position form together an internal shape having a substantially square cross-section. With internal measurements slightly larger than conventional posts, e.g., 4"×4", 5"×5", etc. The panels 14, 16 can be any height desired that protects the base of the post, by way of example only, 4-8". Of course, the internal cross-sectional shape of the panels 14, 16, can be made to match any desired post shape, e.g., the panels 14, 16, in the use position, can form together an internal shape having a substantially rectangular cross-section or substantially circular cross-section.

By the phrase "form together an internal shape having a substantially square cross-section corresponding to the cross-section of the post," applicant means that the panels can for this shape together with, in this embodiment shown, the panel portion 24. Alternatively, in embodiments where the protector panels 14, 16 are both be connected to the base portion 8 by a single hinge without the panel 24, the panels themselves together form the internal shape corresponding to the cross-section of the post.

Figure 3:
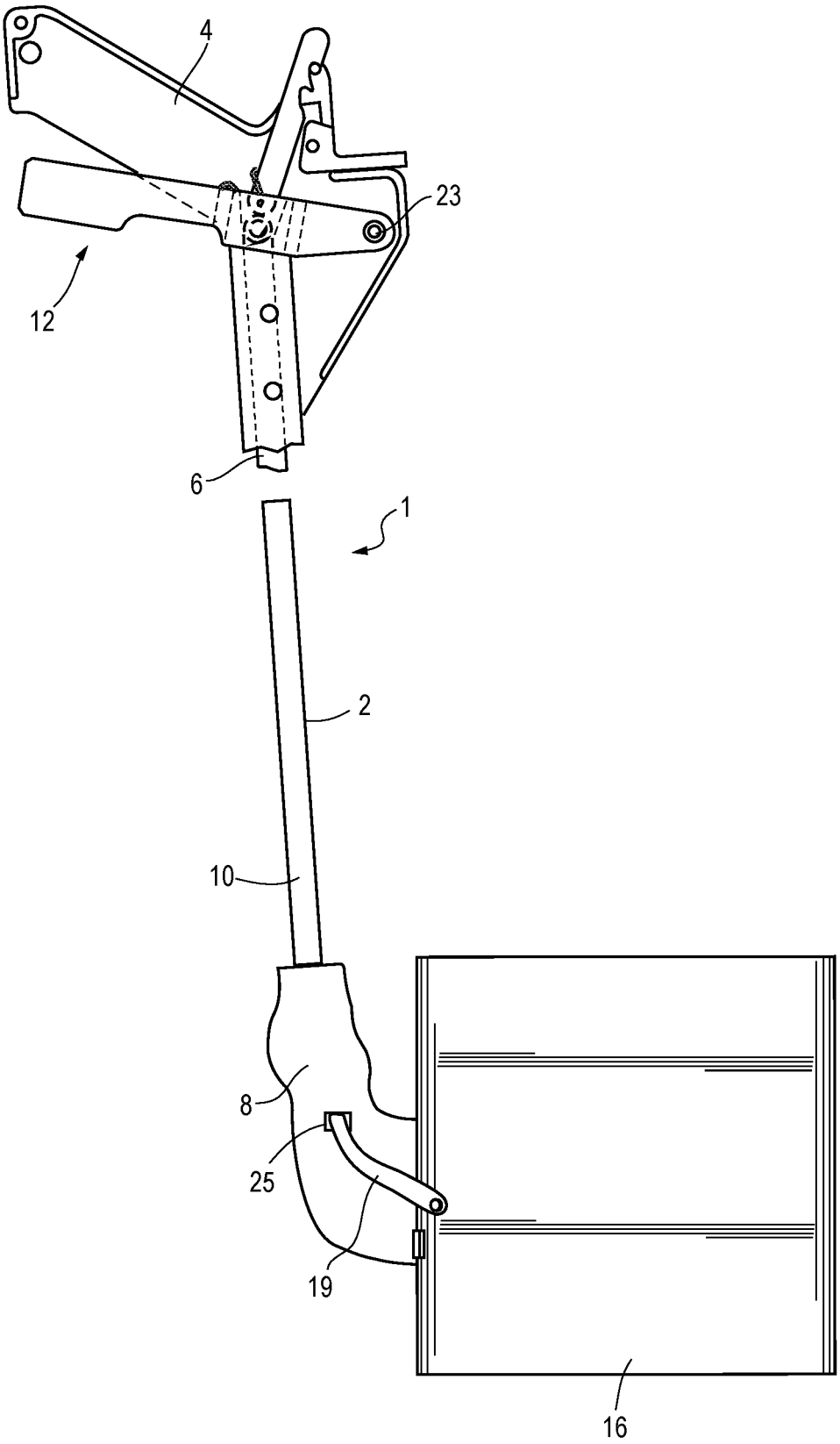
FIG. 3 is a side plan view of an embodiment of a post protector according to the present invention in a use position.
Figure 4:
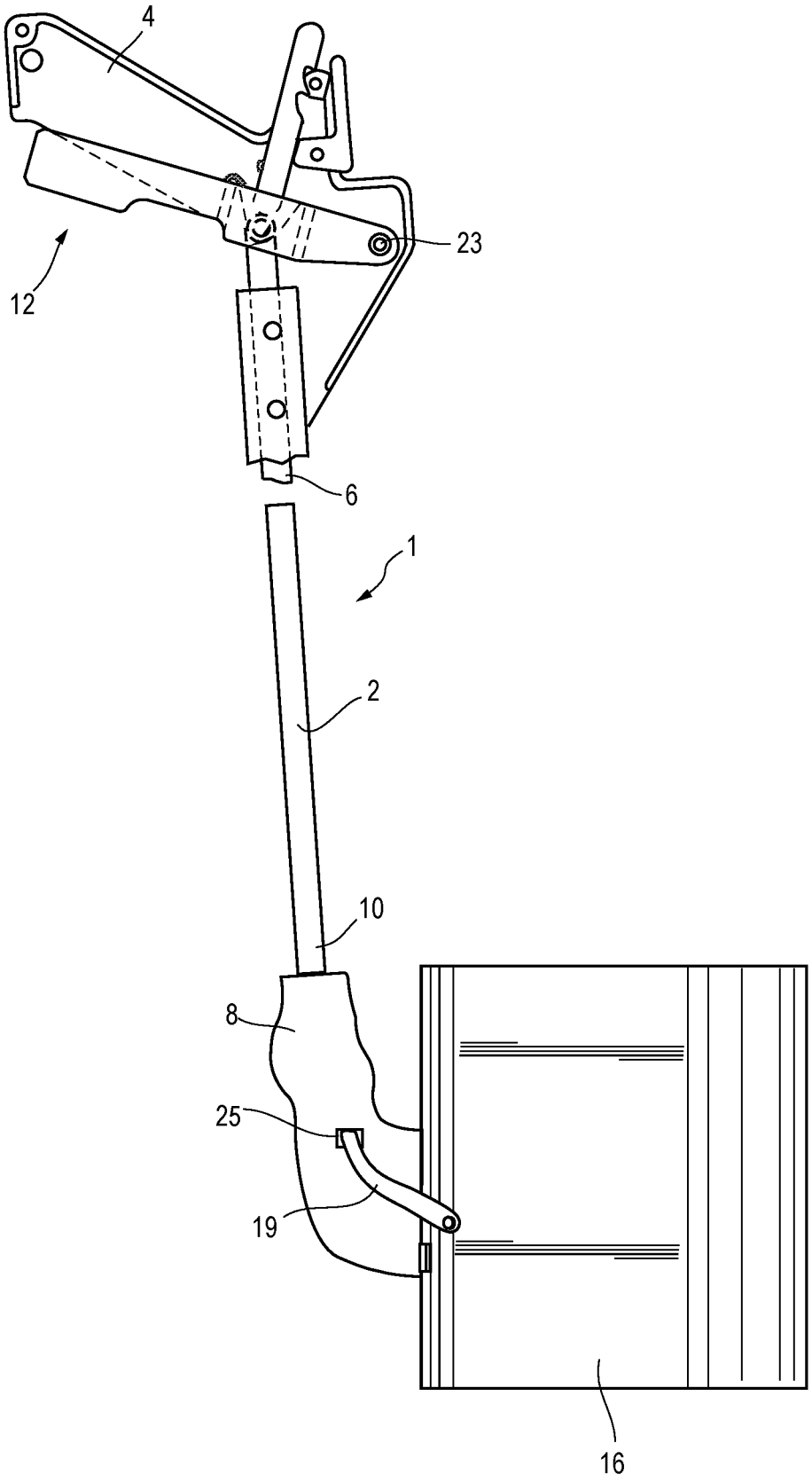
FIG. 4 is a side plan view of an embodiment of a post protector according to the present invention in an installation/removal position.

The trigger 12 in this embodiment is a finger-actuable trigger mounted on the handle 4 with a pivot 23. The trigger being biased apart from the handle 4, e.g., with a torsion spring, but being movable about the pivot 23 towards the handle 4, e.g., by being squeezed in a user's hand. FIG. 3 is a side plan view of this embodiment in the use position with the trigger 12 biased apart from the handle 4. FIG. 4 is a side plan view of this embodiment in an installation/removal position with the trigger 12 pivoted towards the handle 4.

The actuator mechanism is configured to pivot the pair of protector panels 14, 16 into the installation/removal position when the trigger 12 is moved about the pivot 23 towards the handle 4 by being squeezed in a user's hand.

As previously noted, in this embodiment, the actuator mechanism includes a pair of members, e.g., ribbons 18, 19 connected at a first end to the trigger 12, passing down through the hollow shaft 2, and connected at a second end to an outside portion of the pair of protector panels 14, 16. When the trigger 12 is moved about the pivot 23 towards the handle 4 by being squeezed in a user's hand, the ribbons 18, 19 are pulled by the trigger 12 towards the handle 4 so that the ribbons 18, 19 are pulled upwardly in the hollow shaft 2 and the lower ends of the ribbons 18, 19, which extend through openings 24, 25 in the base 8 are pulled, forcing the protector panels 14, 16 to pivot about their hinge(s) 22 to move the pair of protector panels 14, 16 into the installation/removal position. This is best shown in FIGS. 5 and 6.

Figure 5:
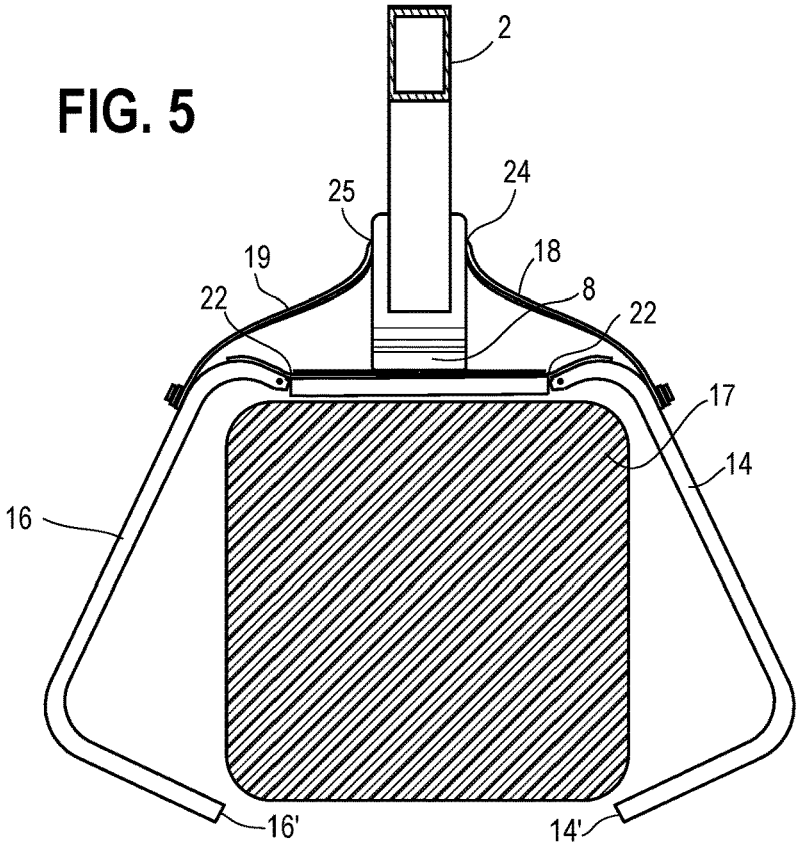
FIG. 5 is a top plan view of an embodiment of a post protector according to the present invention in an installation/removal position.

FIG. 5 is a top plan view of this embodiment in an installation/removal position. This corresponds to the trigger position shown in FIG. 4. In this position, the trigger 12 has been moved about the pivot 23 towards the handle 4 by being squeezed in a user's hand, the ribbons 18, 19 have been thereby pulled by the trigger 12 towards the handle 4 so that the ribbons 18, 19 have been pulled upwardly in the hollow shaft 2 and the lower ends of the ribbons 18, 19 have been pulled, forcing the protector panels 14, 16 to pivot about their hinge(s) 22 to move the pair of protector panels 14, 16 between into the installation/removal position. In this position, the distal ends 14', 16' of the panels 14, 16 are spaced to allow the panels 14, 16 to be installed around or removed from the post 17. That is, the distal ends 14', 16' of the panels 14, 16 are spaced apart by a distance greater than a length/width of a base of a square/rectangular post or greater than a diameter of a circular post.

Figure 6:
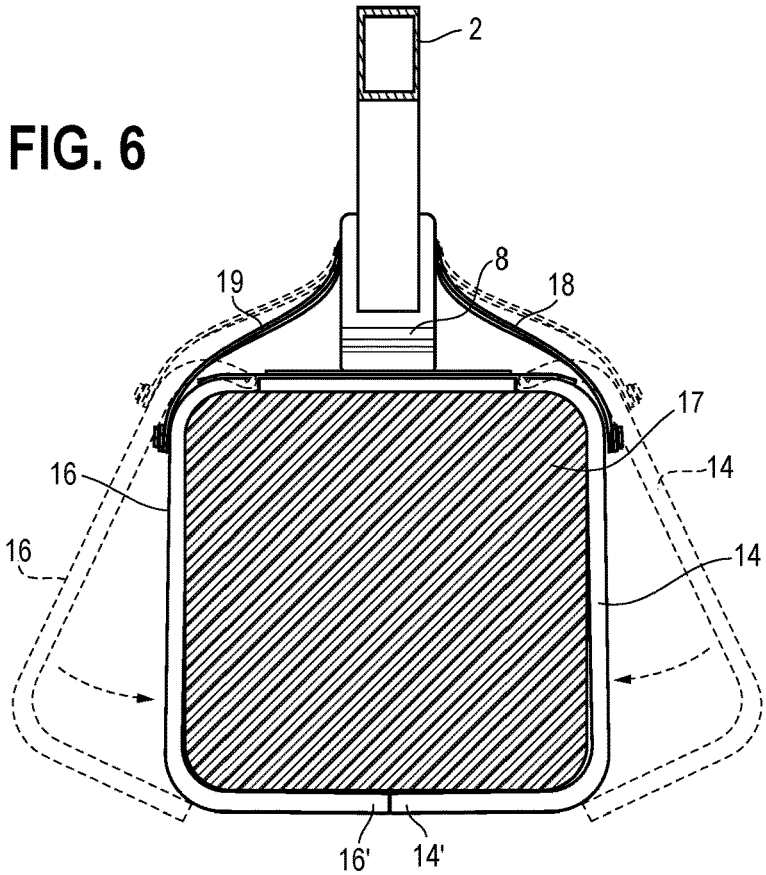
FIG. 6 is a top plan view of an embodiment of a post protector according to the present invention showing an installation/removal position in broken lines and transitioning to a use position.

FIG. 6 is a top plan view of this embodiment showing the installation/removal position in broken lines and transitioning to the use position in solid lines. The use position in solid lines corresponds to the trigger position shown in FIG. 3. In this position, the distal ends 14', 16' of the panels 14, 16 are in contact to form together an internal shape (in this case square) corresponding to at least a portion of an external shape of a post 17.

The post protector 1 may also include a biasing member 26, e.g., in the form of a tension spring plate connected to the panel 24 of the base portion 8, as shown in, e.g., FIG. 2, for biasing the pair of protector panels 14, 16 together in the use position. In this way, the panels 14, 16 are biased in the use position allowing the post protector 1 to stay clamped in the use position to the post 17 in a hands-free manner.

The shaft 2, handle 4, trigger mechanism 12 and an actuator mechanism of the present invention can advantageously employ the corresponding parts of the pickup tool shown and described in U.S. Pat. No. 4,962,957 to Traber, the entire contents of which are incorporated herein by reference. For example, the base portion 8 of the present invention can be attached to the lower end 7 of the shaft 3 described in Traber and the panels 14, 16 attached to the pick-up fingers 9 inst4ad of the grasping means 11 of Traber. The spring arms 17 of Traber are unnecessary for the present invention. The locking devices on the squeezing trigger 29 and handle 27 of Traber are also unnecessary.

I claim:

1. A post protector, comprising:

an elongated hollow shaft;

a handle provided at a first end of the elongated hollow shaft, the handle including a trigger mechanism;

a base portion provided at a second end of the elongated hollow shaft opposite the first end;

a pair of protector panels pivotally connected to the base portion and being movable between a use position in which distal ends of the panels are in contact to form together an internal shape corresponding to at least a portion of an external shape of a post to be protected, and an installation/removal position in which the distal ends of the panels are spaced to allow the panels to be installed around or removed from a post to be protected;

an actuator mechanism provided between and connected to the trigger mechanism and the protector panels, the actuator mechanism being responsive to movement of the trigger mechanism to move the pair of protector panels between the use position and the installation/removal position.

2. The post protector according to claim 1, wherein each of the pair of protector panels is pivotally connected to the base portion by a hinge.

3. The post protector according to claim 2, further comprising a biasing member for biasing the pair of protector panels together in the use position.

4. The post protector according to claim 3, wherein the trigger is a finger-actuable trigger mounted on the handle with a pivot, the trigger being biased apart from the handle but being movable about the pivot towards the handle.

5. The post protector according to claim 4, wherein the trigger is movable about the pivot towards the handle by being squeezed in a user's hand.

6. The post protector according to claim 5, wherein the actuator mechanism comprises a pair of members connected at a first end to the trigger and at a second end to an outside portion of the pair of protector panels, the actuator mechanism being configured to pivot the pair of protector panels into the installation/removal position when the trigger is movable about the pivot towards the handle by being squeezed in a user's hand.

7. The post protector according to claim 1, wherein the pair of protector panels in the use position form together an internal shape having a substantially square cross-section.

8. The post protector according to claim 1, further comprising a biasing member for biasing the pair of protector panels together in the use position.

9. The post protector according to claim 1, wherein the trigger is a finger-actuable trigger pivotally mounted on the handle with a pivot, the trigger being biased apart from the handle but being movable about the pivot towards the handle.

10. The post protector according to claim 9, wherein the trigger is movable about the pivot towards the handle by being squeezed in a user's hand.

11. The post protector according to claim 10, wherein the actuator mechanism comprises a pair of members connected at a first end to the trigger and at a second end to an outside portion of the pair of protector panels, the actuator mechanism being configured to pivot the pair of protector panels into the installation/removal position when the trigger is movable about the pivot towards the handle by being squeezed in a user's hand.

* * * * *